US009293125B2

(12) United States Patent
Hummel

(10) Patent No.: US 9,293,125 B2
(45) Date of Patent: Mar. 22, 2016

(54) TONE EFFECTS SYSTEM

(71) Applicant: Markus Oliver Hummel, Los Altos Hills, CA (US)

(72) Inventor: Markus Oliver Hummel, Los Altos Hills, CA (US)

( * ) Notice: Subject to any disclaimer, the term of this patent is extended or adjusted under 35 U.S.C. 154(b) by 0 days.

(21) Appl. No.: 14/632,521

(22) Filed: Feb. 26, 2015

(65) Prior Publication Data

US 2015/0170626 A1 Jun. 18, 2015

Related U.S. Application Data

(63) Continuation of application No. 14/073,689, filed on Nov. 6, 2013, now Pat. No. 9,012,759.

(60) Provisional application No. 61/724,106, filed on Nov. 8, 2012.

(51) Int. Cl.

| | |
|---|---|
| ***G10H 1/02*** | (2006.01) |
| ***G10H 1/00*** | (2006.01) |
| ***G10H 1/32*** | (2006.01) |
| ***G10H 3/18*** | (2006.01) |
| ***G10H 1/34*** | (2006.01) |

(52) U.S. Cl.

CPC ..... *G10H 1/02* (2013.01); *G10H 1/0091* (2013.01); *G10H 1/32* (2013.01); *G10H 1/342* (2013.01); *G10H 3/186* (2013.01)

(58) Field of Classification Search

CPC ..... G10H 1/02; G10H 1/0091; G10H 1/32; G10H 3/186; G10H 1/342

USPC ..... 84/737, 743

See application file for complete search history.

(56) References Cited

U.S. PATENT DOCUMENTS

| | | | | |
|---|---|---|---|---|
| 4,509,190 | A * | 4/1985 | Spector | 381/61 |
| 5,637,823 | A * | 6/1997 | Dodge | 84/743 |
| 5,767,432 | A * | 6/1998 | Randolph | 84/743 |
| 6,075,194 | A * | 6/2000 | Marinic et al. | 84/622 |
| 6,376,761 | B1 * | 4/2002 | LaMarra et al. | 84/670 |
| 7,326,849 | B2 * | 2/2008 | Adams et al. | 84/746 |
| 7,711,442 | B2 * | 5/2010 | Ryle et al. | 700/94 |
| 7,786,371 | B1 * | 8/2010 | Moates | 84/645 |
| 7,838,758 | B2 * | 11/2010 | Van Ekstrom | 84/743 |
| 8,075,342 | B1 * | 12/2011 | Harney et al. | 439/620.01 |

* cited by examiner

*Primary Examiner* — Jeffrey Donels

(57) ABSTRACT

A tone effects system for use with electric instruments that allows for reduced or eliminated signal loss before sound effects are applied. A cartridge receiver and a changeover switch are integrated into the body of a desired electric instrument, while an effects cartridge is attached to the electric instrument via the cartridge receiver. The cartridge receiver provides electronic connections between the electric instrument and the effects cartridge, while the changeover switch is used to direct the electronic signal of the electric instrument through the effects cartridge. The effects cartridge provides an effects circuit for manipulating the received electronic signal, as well as an at least one effects control for adjusting the extent to which the effect is applied to the electronic signal. As the effects cartridge is attached to the electric instrument, the at least one effects control is readily accessible while the electric instrument is being played.

11 Claims, 15 Drawing Sheets

TONE EFFECTS SYSTEM

The current application is a continuation of U.S. patent application Ser. No. 14/073,689 filed on Nov. 6, 2013 which claims benefit of U.S. Provisional Patent Application 61/724,106 filed on Nov. 8, 2012.

FIELD OF THE INVENTION

The present invention relates generally to electronic instrument effects. More specifically, the present invention is an apparatus for various sound effects or appliances that are integrated directly into the body of an electric musical instrument for easy access, manipulation of controls and interchangeability.

BACKGROUND OF THE INVENTION

In the music industry, it has often been desirable to alter the sound produced from a musical instrument using sound effects. Sound effects were originally produced using techniques such as manipulating reel-to-reel tape after recording or through microphone placement during recording. As such, early sound effects were limited to in studio productions. The ability for individual musicians to manipulate instrument sounds in-home became available with the emergence of sound effects modules. Sound effects modules are electronic devices that allow musicians to manipulate the sound produced from an electric or electronic instrument. Earlier standalone sound effects modules were impractical as the equipment was both bulky and costly. Thus, the first practical sound effects modules to be used regularly outside of the studio were those built into amplifiers using vacuum tubes. With the emergence of the electronic transistor, sound effects circuitry was able to be even further condensed into small, portable containers commonly referred to as stompbox units. Stompbox units can be designed to produce one or more effects and typically provide a number of controls for adjusting the extent to which the sound of the instrument is manipulated.

While sound effects modules are used with many different types of musical instruments, sound effects modules are most notably used in conjunction with electric guitars in the form of stompboxes. One issue with the use of stompboxes with electric guitars is cable signal loss, which is due, at least in part, to the length of the guitar cable that is used between the guitar and the stompboxes. The cable signal loss across the guitar cable between where the electronic signal of the guitar is generated to where the sound effect is applied results in a loss in tone, which is undesirable to most musicians. Ideally, tone effects are applied as close to the signal generation as possible in order to reduce the amount of signal loss that occurs before the effect is applied. Another issue associated with stompboxes is their accessibility. Stompboxes are typically either placed at the feet of the user or mounted together on a rack. Thus, in order for a musician to adjust the effects controls they must do so with their feet or be within an arm's reach of the rack. Resultantly, effects controls are typically adjusted before a set or an individual song and are not altered throughout.

Therefore it is an object of the present invention to provide an apparatus that integrates electronic effects modules directly into the body of an electric instrument for easy access and manipulation of controls, reduction in signal loss before applied effects, and interchangeability of effects modules. A cartridge receiver and a changeover switch are integrated into the body of the instrument, while an effects cartridge is attached to the instrument via the cartridge receiver. Signal loss between signal generation and the applied sound effect is reduced or altogether eliminated as the cartridge receiver is mounted directly onto the electric instrument, thus reducing the length of wire that the generated electronic signal must traverse in order to reach the effects cartridge. The cartridge receiver provides electronic connections between the electric instrument and the effects cartridge, while the changeover switch is used to direct the electronic signal of the electric instrument through the effects cartridge. The effects cartridge provides the circuitry for manipulating the received electronic signal, as well as tone effects controls for adjusting the extent to which the effect is applied to the electronic signal. The present invention gives a musician much more creativity and control by placing tone effects controls within a hand's reach while the instrument is being played.

DETAIL DESCRIPTIONS OF THE INVENTION

All illustrations of the drawings are for the purpose of describing selected versions of the present invention and are not intended to limit the scope of the present invention.

The present invention is a tone effects system for use with electric or electronic instruments that allows for reduced or eliminated signal loss before sound effects are applied to the electronic signal of the instrument. While the present invention is intended for use with electric guitars, the tone effects system can be used with any other electric or electronic instrument. In the preferred embodiment of the present invention, the tone effects system is designed to be retrofitted to an existing instrument; however, the tone effects system may be integrated into new instruments at the time of manufacture if so desired.

The tone effects system comprises a cartridge receiver 1, an effects cartridge 2, and a changeover switch 3. The cartridge receiver 1 is attached to the desired instrument and serves as a docking station for the effects cartridge 2. The effects cartridge 2 allows the user to readily manipulate the electronic signal of the electric instrument, while the changeover switch 3 is used to direct the electronic signal of the electric instrument through the effects cartridge 2. Signal loss between where the electronic signal is generated and where the sound effect is applied is significantly reduced as a result of the effects cartridge being closely wired to where the electronic signal is generated within the electric instrument. The effects cartridge 2 is removably attached to the cartridge receiver 1 such that the effects cartridge 2 configured to produce one sound effect can be replaced with the effects cartridge 2 configured to produce a different sound effect.

Figure 1:
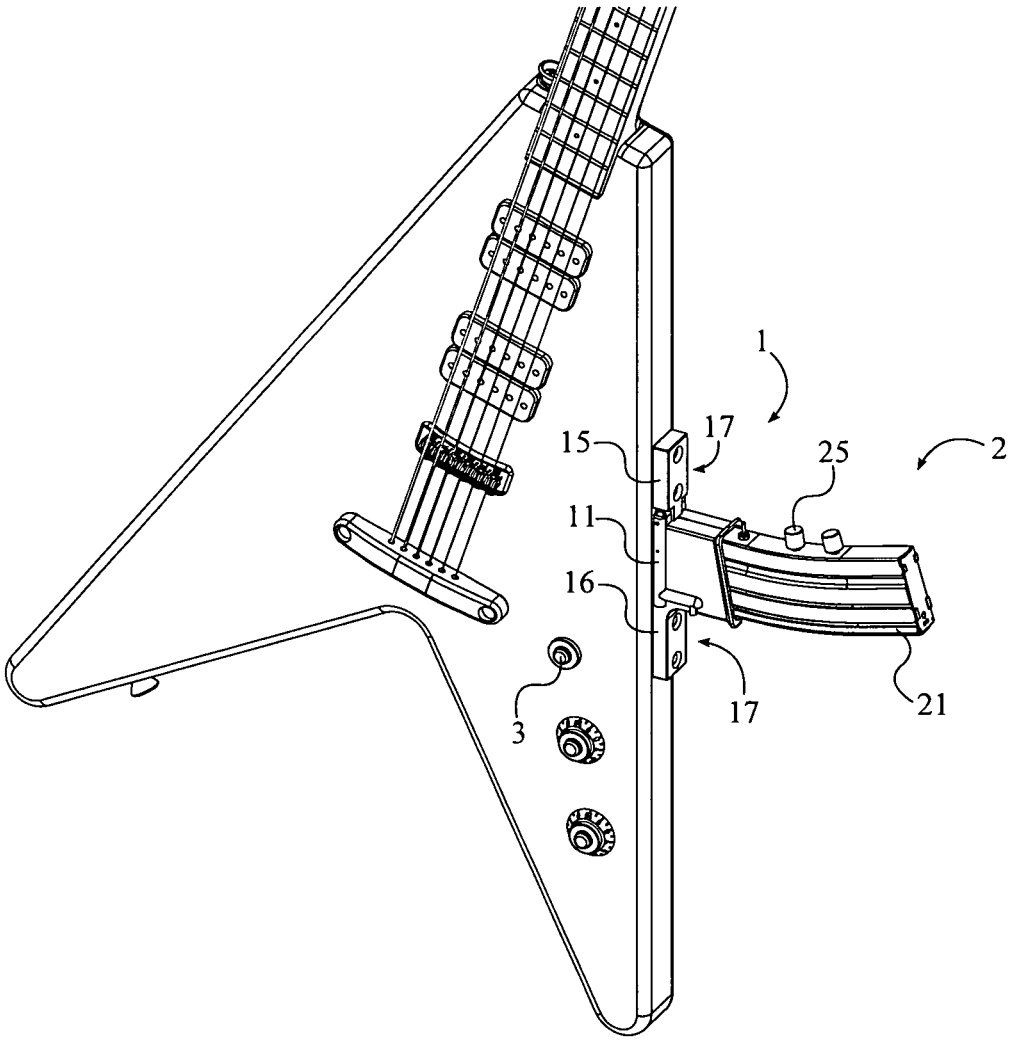
FIG. 1 is a perspective view of the present invention retrofitted onto an electric guitar.

In reference to FIG. 1, the receiver and the changeover switch 3 are connected to the desired electric instrument such that they are accessible to the user. In the preferred embodiment of the present invention, the cartridge receiver 1 is mounted externally on the desired electric instrument; however, it is also possible for the cartridge receiver 1 to be mounted to the desired electric instrument internally. Ideally, the changeover switch 3 is used as a replacement to an existing control of the electric instrument. For example, if the tone effects system is used in conjunction with an electric guitar, then a tone control of the electric guitar can be removed and replaced with the changeover switch 3, thus minimizing any alterations to the instrument (i.e. drilling additional holes into the instrument body). Of course, it is also possible for the changeover switch 3 to be mounted to any other accessible region of the instrument.

Figure 2:
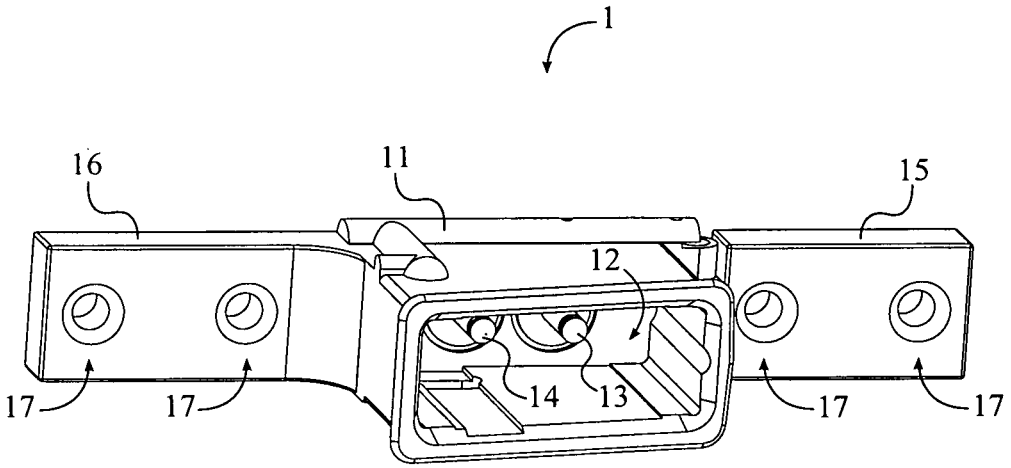
FIG. 2 is a perspective view of the cartridge receiver.

In reference to FIG. 2, the cartridge receiver 1 comprises a receiver body 11, a receiving volume 12, a signal-in terminal 13, a signal-out terminal 14, a first flange 15, a second flange 16, and a plurality of holes 17. The receiving body is the central structure of the cartridge receiver 1 and defines the general shape of the cartridge receiver 1. The receiving volume 12 is positioned into the receiver body 11 and is the empty space into which the effects cartridge 2 is positioned when the effects cartridge 2 is attached to the cartridge receiver 1. Both the signal-in terminal 13 and the signal-out terminal 14 are connected to the receiver body 11 and positioned adjacent to each other within the receiving volume 12. The cartridge receiver 1 is electronically connected to the effects cartridge 2 through the signal-in terminal 13 and the signal-out terminal 14.

In reference to FIG. 2, the first flange 15, the second flange 16, and the plurality of holes 17 provide a means of connection between the electric instrument and the cartridge receiver 1. The first flange 15 and the second flange 16 are adjacently connected to the receiver body 11, while the plurality of holes 17 traverses through both the first flange 15 and the second flange 16. Screws are inserted through each of the plurality of holes 17 and threaded into screw holes drilled into the electric instrument in order to connect the cartridge receiver 1 to the electric instrument. Alternatively, the screws can be threaded directly into the surface of the electric instrument. Additional holes are drilled through the electric instrument adjacent to the receiver body 11 in order to allow electrical wire to be connected to the signal-in terminal 13 and the signal-out terminal 14.

In reference to FIG. 1-2, the first flange 15 and the second flange 16 are positioned on the receiver body 11 opposite the receiving volume 12. In this way, the first flange 15, the second flange 16, and the top of the receiver body 11 rest flush against the surface of the electric instrument, while the receiving volume 12 is directed away from the electric instrument, such that the effects cartridge 2 can be attached to the cartridge receiver 1. The first flange 15 and the second flange 16 are positioned opposite each other across the receiver body 11 in order to securely hold the cartridge receiver 1 flush against the surface of the electric instrument. It is also possible for the cartridge receiver 1 to be connected to the electric instrument in any other way, such as being internally mounted within the electric instrument.

Figure 3:
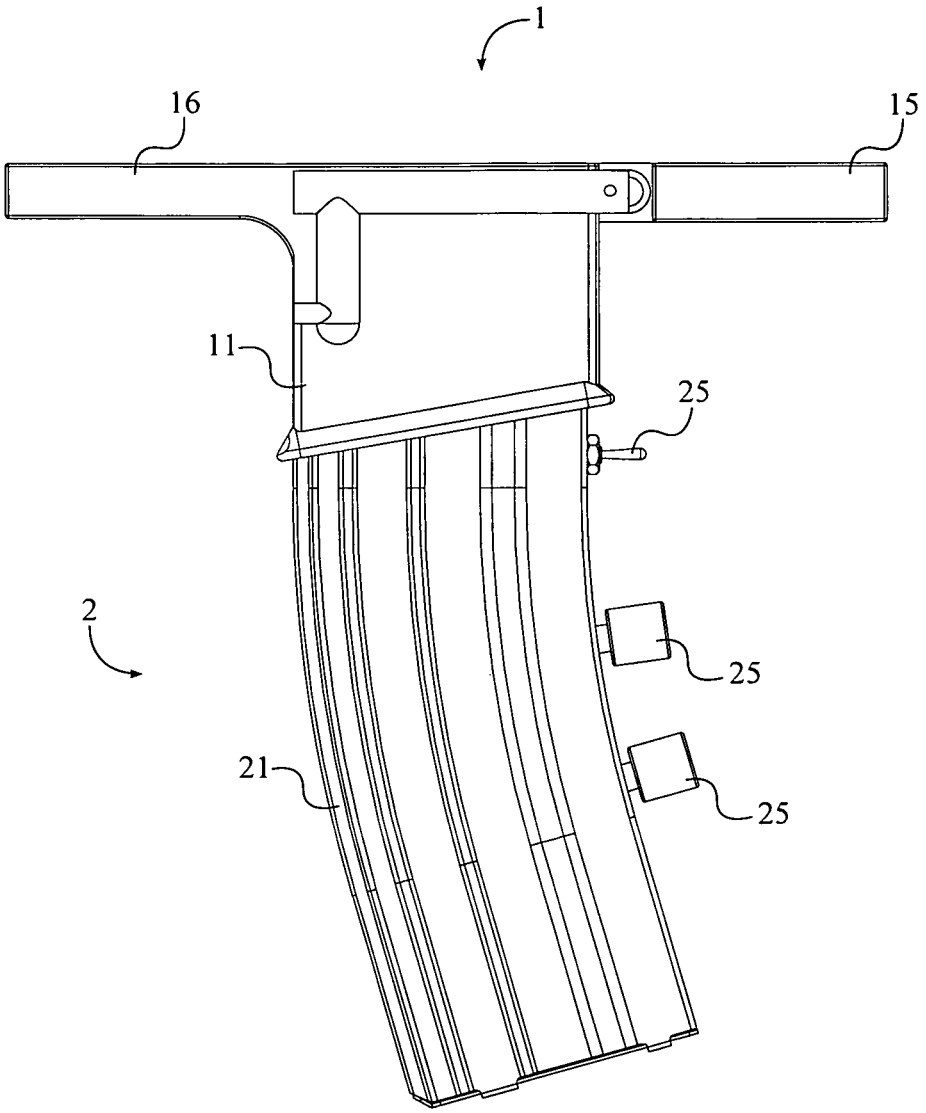
FIG. 3 is a left-side elevational view of the effects cartridge positioned within the cartridge receiver.
Figure 4:
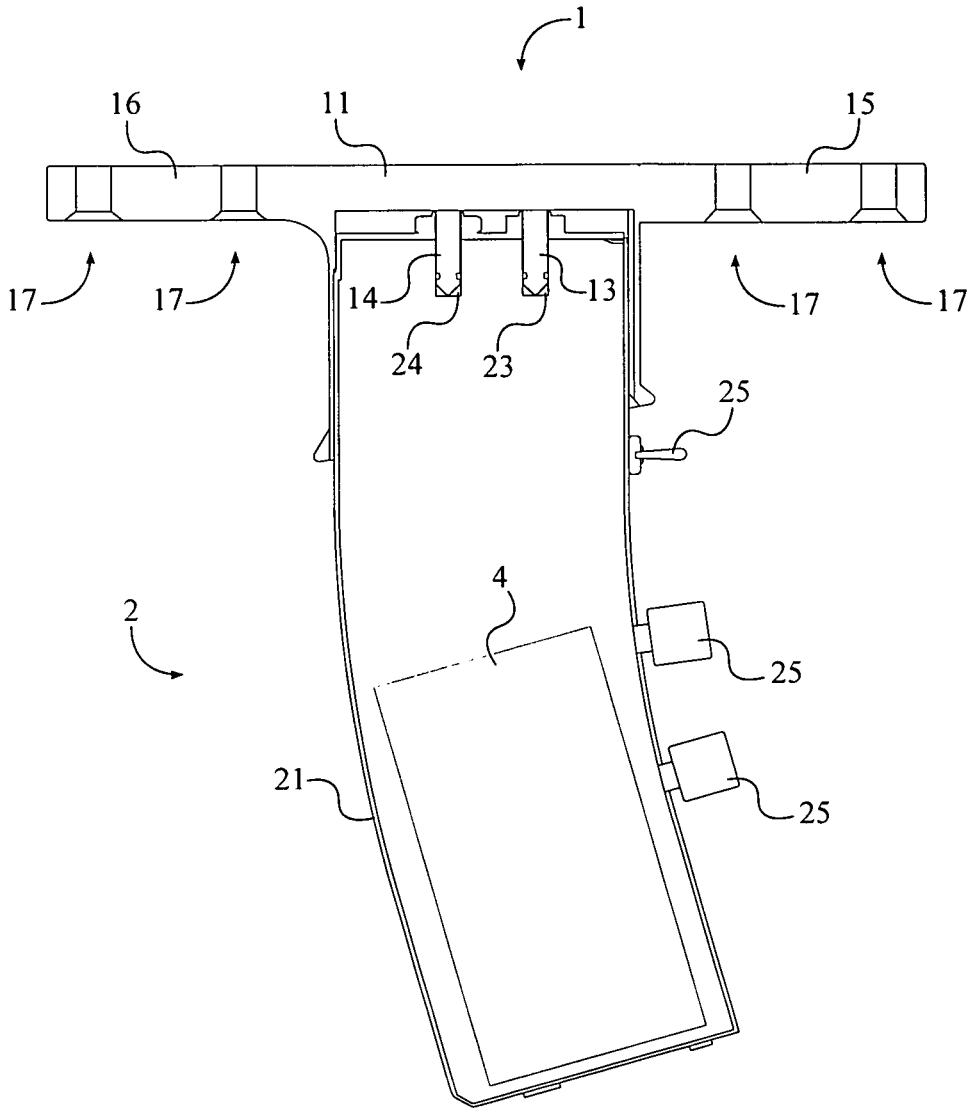
FIG. 4 is a left-side sectional view of the effects cartridge positioned within the cartridge receiver.

In reference to FIG. 3-4, the effects cartridge 2 is the component of the tone effects system that allows the electronic signals of the electric instrument to be manipulated in order to produce the desired sounds from the electric instrument. The effects cartridge 2 comprises a cartridge casing 21, a signal-in port 23, a signal-out port 24, an effects circuit 4, and an at least one effects control 25. The cartridge casing 21 is a generally thin-walled structure that provides a housing for the effects circuit 4, as well as a mounting frame for the signal-in port 23, the signal-out port 24, and the at least one effects button. The effects circuit 4 is positioned within the cartridge casing 21 and provides the various electrical components and wiring required to manipulate the electronic signal of the electric instrument in the desired manner. The signal-in port 23 and the signal-out port 24 are positioned adjacent to each other through the top side of the cartridge casing 21 and are both connected to the cartridge casing 21. The effects cartridge 2 is electronically connected to the cartridge receiver 1 through the signal-in port 23 and the signal-out port 24. Additionally, the signal-in port 23 and the signal-out port 24 are electronically connected to the effects circuit 4.

In reference to FIG. 1, the changeover switch 3 is ideally integrated into the body of the electronic instrument as the replacement for a pre-existing instrument control, such as the tone knob of an electric guitar. The changeover switch 3 allows the user to direct the electronic signal produced by the electric instrument from a normal path through the electric instrument to a manipulated path through the effects cartridge 2. The normal path follows the circuit of the electric instrument, while the manipulated path follows the effects circuit 4 of the effects cartridge 2 in order to manipulate the electronic signal of the electric instrument to produce the desired sound. As such, the changeover switch 3 is electronically connected to the signal-in terminal 13 in order to operatively couple the changeover switch 3 to the effects circuit 4.

In the preferred embodiment of the present invention, the changeover switch 3 is a push-on/push-off style switch, wherein the changeover switch 3 is used to direct the electronic signal between the normal path and the manipulated path. When the changeover switch 3 is in the off position, the electronic signal is directed along the normal path through the circuit of the electric instrument and is not manipulated. When the changeover switch 3 is in the on position, the electronic signal is directed along the manipulated path through the effects circuit 4 and manipulated in accordance with the configuration of the effects circuit 4.

In reference to FIG. 4, when the effects cartridge 2 is attached to the cartridge receiver 1, the top end of the cartridge casing 21 is positioned into the receiving volume 12 of the cartridge receiver 1. As the cartridge casing 21 is inserted into the receiving volume 12, the signal-in terminal 13 engages the signal-in port 23, such that the signal-in terminal 13 is positioned into the signal-in port 23. Similarly, the signal-out terminal 14 engages the signal-out port 24, such that the signal-out terminal 14 is positioned into the signal-out port 24. In reference to FIG. 5, when the signal-in terminal 13 is positioned into the signal-in port 23, the signal-in terminal 13 is electronically connected to the signal-in port 23, thus allowing the electronic signal of the electric instrument to be passed through the effects circuit 4 when the changeover switch 3 is in the on position. Likewise, when the signal-out terminal 14 is positioned into the signal-out port 24, the signal-out terminal 14 is electronically connected to the signal-out port 24, thus allowing the manipulated electronic signal to re-enter the circuit of the electric instrument forming the normal path.

Figure 5:
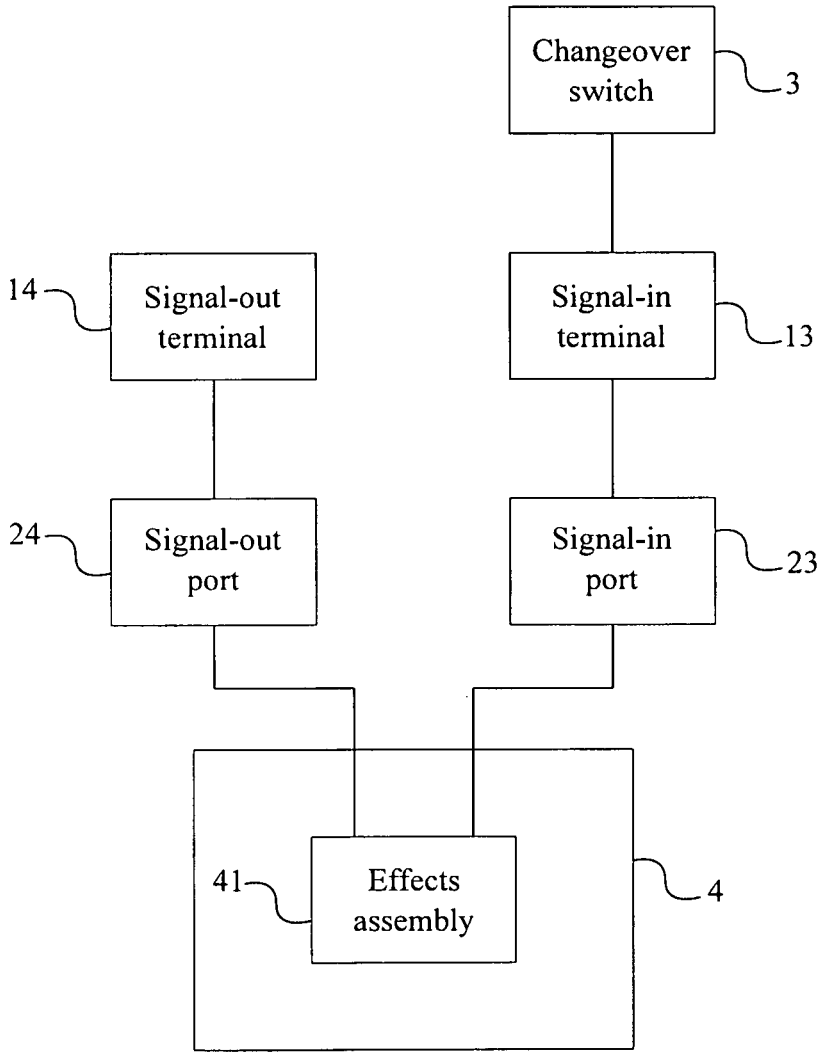
FIG. 5 is a diagram depicting the electrical connections of the effects circuit, effects cartridge, cartridge receiver, and changeover switch.

In the preferred embodiment of the present invention, the effects circuit 4 comprises an effects assembly 41 and a power source 42. The effects assembly 41 provides electronic components for manipulating the electronic signals received from the electric instrument before the electronic signals are returned along the normal path. As such, the effects assembly 41 is electronically connected to the signal-in port 23 and the signal-out port 24, as shown in FIG. 5. The effects circuit 4 may include any electronic components commonly used in the art of tone effects, such as resistors, capacitors, transistors, etc. The electronic components may be arranged in any number of ways in order to produce the desired tone effect. For example, the effects assembly 41 may be configured to produce the tone effect associated with any traditional effects pedals, such as a compressor, booster, wah-wah, overdrive, fuzz, distortion, phaser, flanger, chorus, reverb, delay, or amp modeler pedal. The effects assembly 41 may be configured to produce one tone effect or multiple tone effects.

Figure 6:
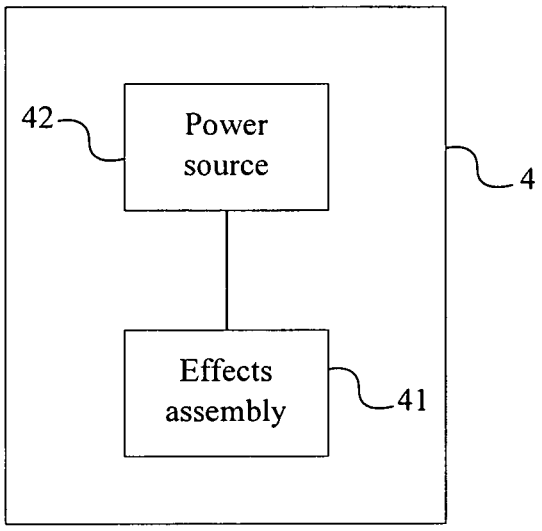
FIG. 6 is a diagram depicting the electrical connection between the effects assembly and the power source.

The effects assembly 41 is electrically connected to the power source 42, as shown in FIG. 6, such that the power source 42 supplies current to the electronic components of the effects assembly 41. The power source 42 is ideally a battery, either rechargeable or non-rechargeable, and can use any known type of battery technology, such as lithium-ion technology, nickel-cadmium technology, etc. If the power source 42 is a rechargeable battery, then a charging port may also be integrated into the cartridge casing 21, such that the power source 42 does not need to be removed for recharging. If the power source 42 is a non-rechargeable battery, then an access panel may be integrated into the cartridge casing 21 in order to allow the power source 42 to be removed and replaced. If the power source 42 is not a battery, then the cartridge casing 21 may provide a charging port for attaching a power cord between the power source 42 and a power supply such as an outlet.

Characteristics of the effects circuit 4 are adjusted through the at least one effects control 25. As such, the at least one effects control 25 is electronically connected to the effects circuit 4. The at least one effects control 25 is positioned externally on the cartridge casing 21 and is connected to the cartridge casing 21, such that the at least one effects button is readily accessible to the user. The at least one effects control 25 can be used to adjust the extent to which the electronic signal of the electric instrument is manipulated. For example, if the effects assembly 41 is configured to cause distortion in the electronic signal, then the at least one effects control 25 could be a knob used to adjust the level of distortion. Alternatively, the at least one effects control 25 can be a power switch used to control the current supplied by the power source 42.

Figure 7:
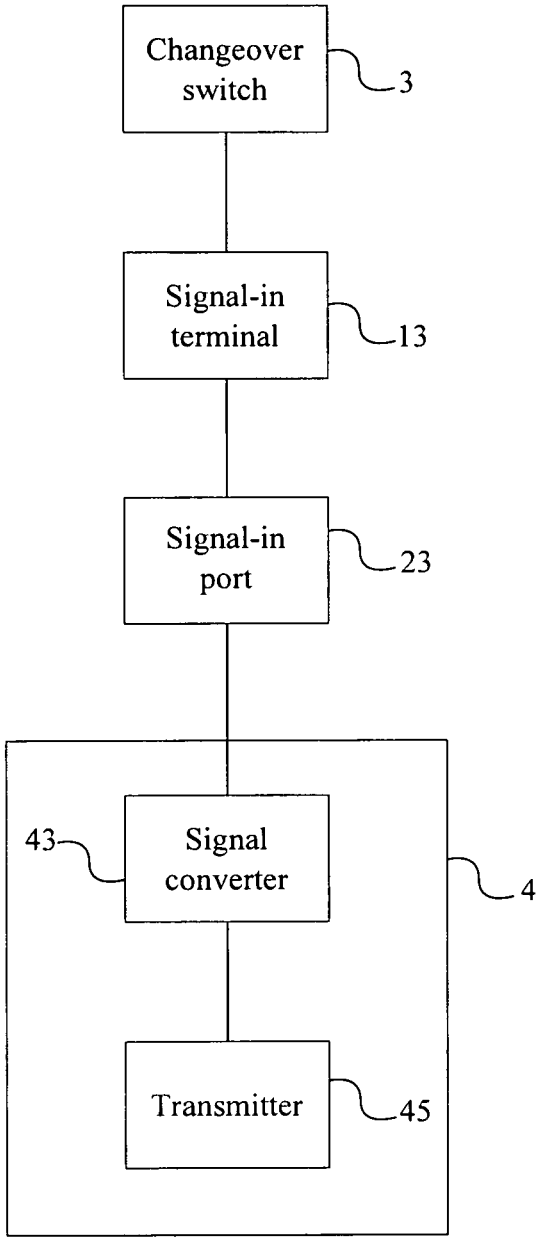
FIG. 7 is a diagram depicting the electrical connections of the transmitter, signal converter, effects cartridge, cartridge receiver, and changeover switch.
Figure 8:
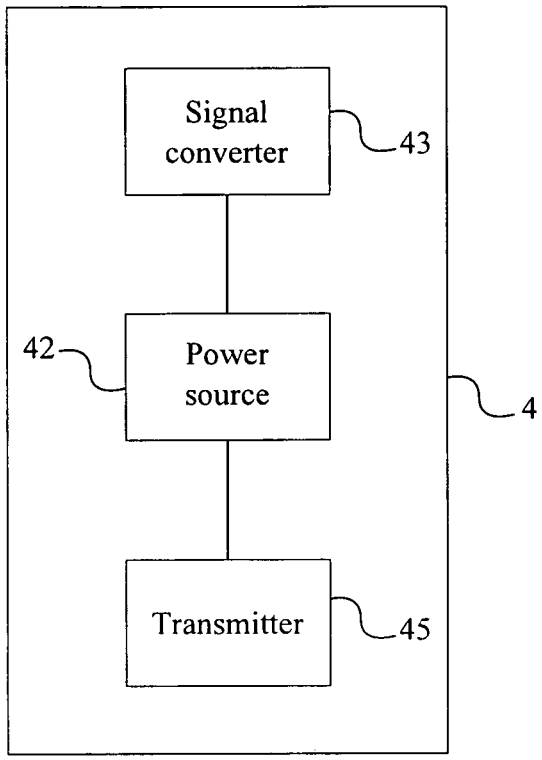
FIG. 8 is a diagram depicting the electrical connection between the signal converter and the transmitter.

In one embodiment of the present invention, the effects circuit 4 comprises a signal converter 43 and a transmitter 45. The signal converter 43 alters the electronic signal of the electric instrument from an analog signal to a digital signal, such that the transmitter 45 is able to transmit the converted electronic signal to an electronic device synchronized with the effects circuit 4. As such, the signal converter 43 is electronically connected to both the signal-in port 23 and the transmitter 45, as shown in FIG. 7. The transmitted electronic signal can then be manipulated by the synchronized electronic device. As the electronic signal of the electric instrument is transmitted to the electronic device, the electronic signal does not need to re-enter the normal path of the electric instrument. Therefore, the effects cartridge 2 does not need to comprise the signal-out port 24. The power source 42 is electrically connected to the signal converter 43 and the transmitter 45, as shown in FIG. 8, and thus supplies current to both the signal converter 43 and the transmitter 45.

Figure 9:
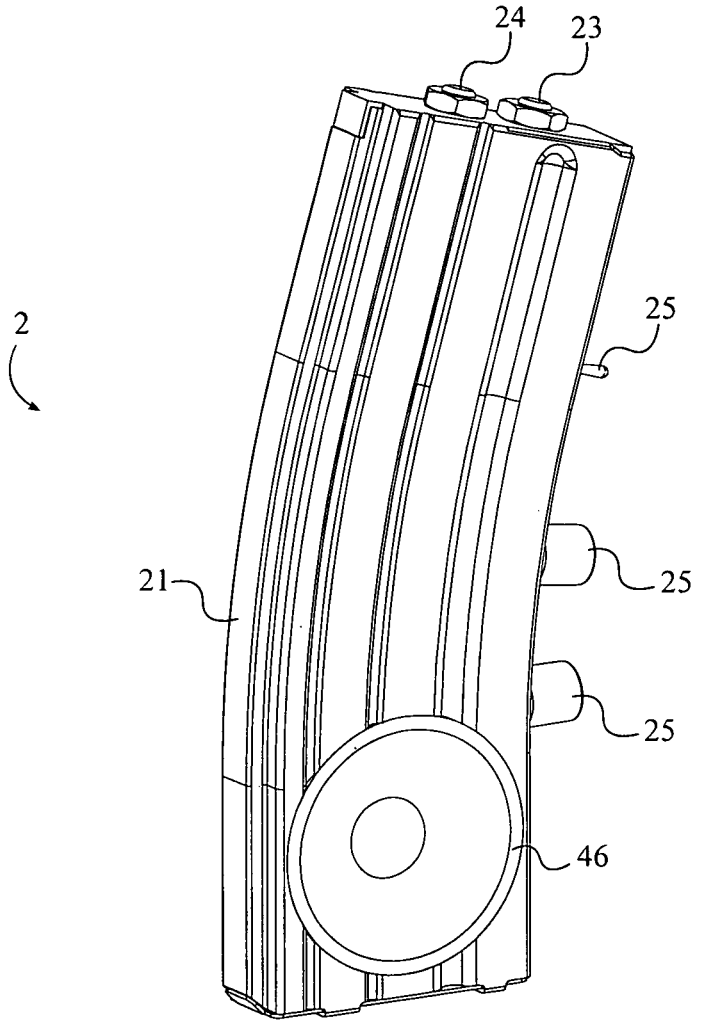
FIG. 9 is a perspective view of the effects cartridge having a speaker.
Figure 10:
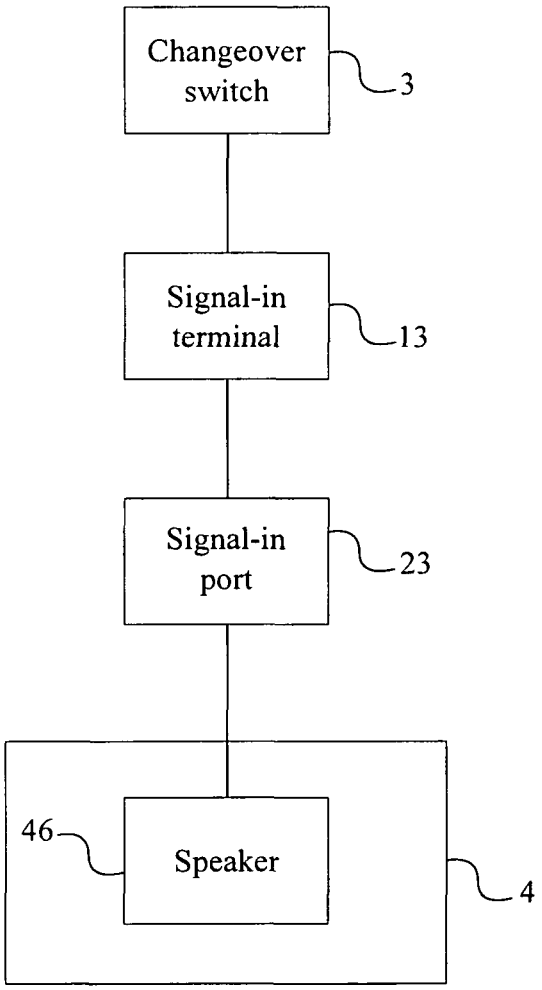
FIG. 10 is a diagram depicting the electrical connections of the speaker, effects cartridge, cartridge receiver, and changeover switch.
Figure 11:
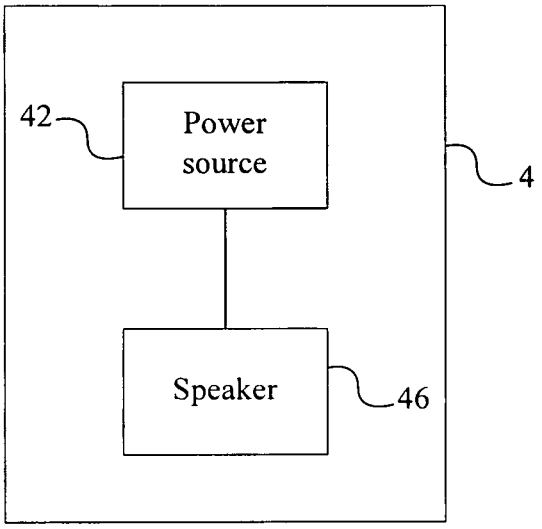
FIG. 11 is a diagram depicting the electrical connection between the speaker and the power source.

In another embodiment of the present invention, the effects circuit 4 comprises a speaker 46. The speaker 46 allows the present invention to produce sound directly from the effects cartridge 2. As such, the speaker 46 is positioned through the cartridge casing 21, as shown in FIG. 9, and is electronically connected to the signal-in port 23, as shown in FIG. 10. The incoming electronic signal is directed through a driver of the speaker 46 in order to amplify the electronic signal such that the electronic signal can be used to drive the speaker 46. As the electronic signal of the electric instrument is directed through the built in speaker 46, the electronic signal does not need to re-enter the normal path of the electric instrument. Therefore, the effects cartridge 2 does not need to comprise the signal-out port 24. The power source 42 is electrically connected to the speaker 46, as shown in FIG. 11, and thus supplies current to the speaker 46.

Figure 12:
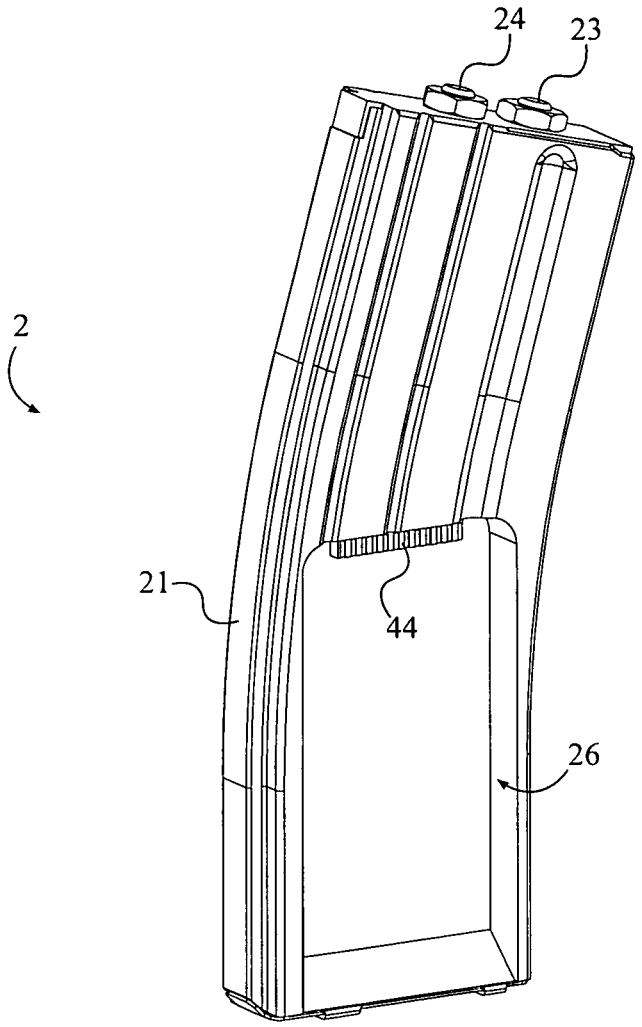
FIG. 12 is a perspective view of the effects cartridge having a device dock.
Figure 13:
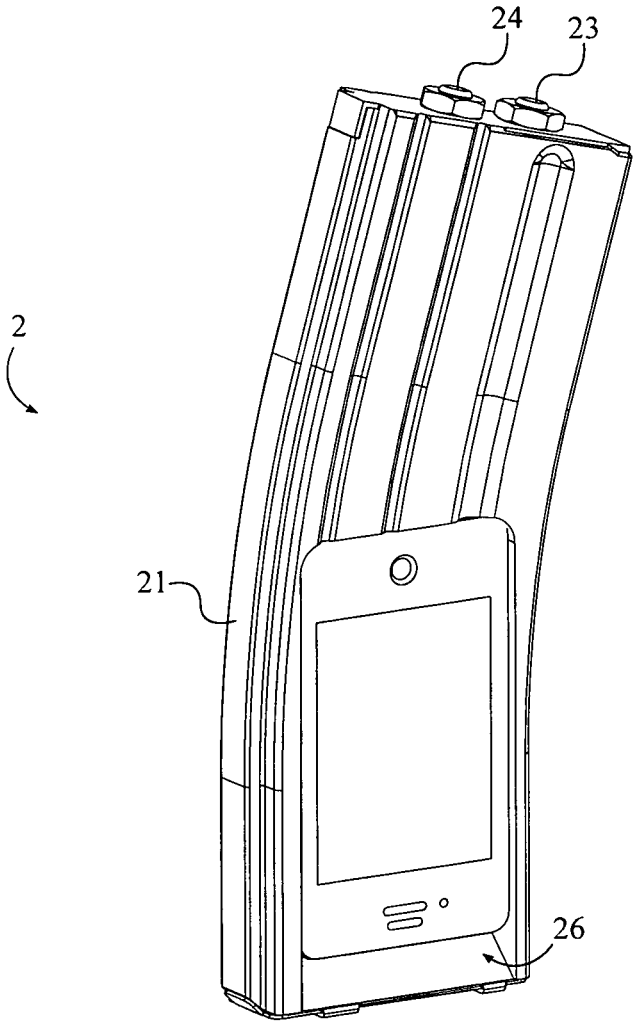
FIG. 13 is a perspective view of an electronic device positioned within the device dock.
Figure 14:
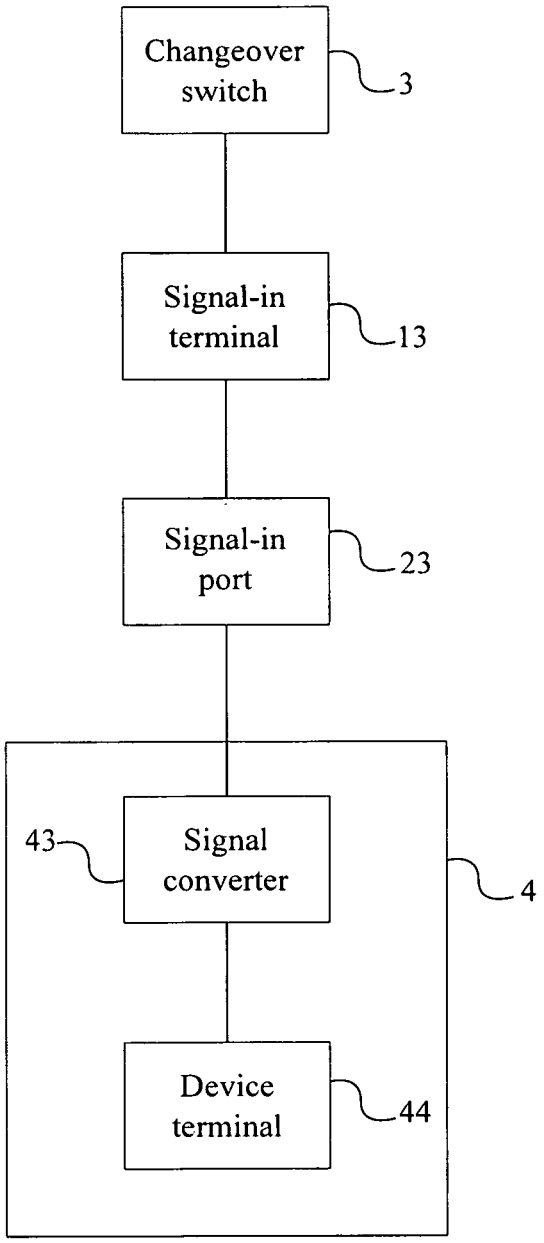
FIG. 14 is a diagram depicting the electrical connections of the device terminal, signal converter, effects cartridge, cartridge receiver, and changeover switch.
Figure 15:
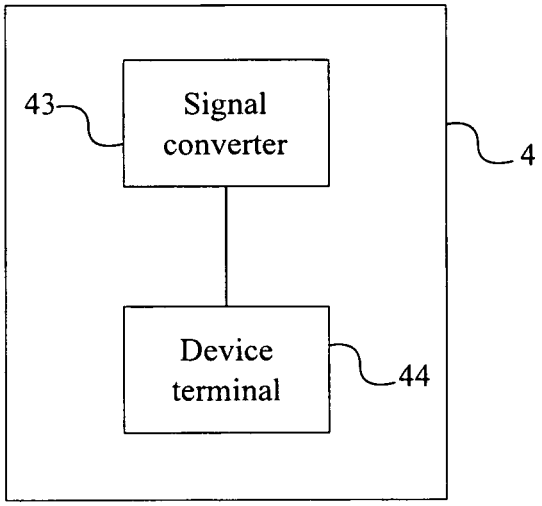
FIG. 15 is a diagram depicting the electrical connection between the device terminal and the signal converter.

In yet another embodiment of the present invention, the effects circuit 4 comprises the signal converter 43 and a device terminal 44. Additionally, the effects cartridge 2 further comprises a device dock 26, as shown in FIG. 12. The device dock 26 is a cavity positioned into the cartridge casing 21 that allows an electronic device, such as a mobile phone, to be attached to the effects cartridge 2. The device terminal 44 is connected to the cartridge casing 21 and is positioned into the device dock 26. The device terminal 44 provides a data connection, as well as an electrical connection, between the effects cartridge 2 and the electronic device. As such, the device terminal 44 is electronically connected to the signal converter 43, which is in turn electronically connected to the signal-in port 23, as shown in FIG. 14. When the electronic device is positioned within the device dock 26 and attached to the device terminal 44, as shown in FIG. 13, the incoming electronic signal is directed through the signal converter 43, such that it can then be directed to the electronic device through the device terminal 44. As the electronic signal of the electric instrument is transmitted to the electronic device, the electronic signal does not need to re-enter the normal path of the electric instrument. Therefore, the effects cartridge 2 does not need to comprise the signal-out port 24. Additionally, as the device terminal 44 is electrically connected to the signal converter 43, as shown in FIG. 15, current can be supplied to the signal converter 43 from the electronic device, such that the power source 42 is not needed. The electronic device can be used to apply sound effects to the electronic signal, transmit the electronic signal to another device, record the electronic signal, etc.

Any of the above described embodiments of the effects circuit 4 may be used partly or fully in conjunction with each other, or as a standalone system.

Although the invention has been explained in relation to its preferred embodiment, it is to be understood that many other possible modifications and variations can be made without departing from the spirit and scope of the invention as hereinafter claimed.

What is claimed is:

1. A tone effects system comprises:
an effects cartridge;
a cartridge receiver;
the effects cartridge being attached to the cartridge receiver;
the effects cartridge comprises a cartridge casing;
the cartridge receiver comprises a receiver body, a first flange, a second flange;
the first flange and the second flange being adjacently connected to the receiver body;
the first flange and the second flange being positioned opposite each other across the receiver body;
a changeover switch;
the effects cartridge further comprises a signal-in port, a signal-out port, and an effects circuit;
the changeover switch being electronically connected to the signal-in terminal;
the signal-out port being positioned adjacent to the signal-in port;
the plurality of holes traversing through both the first flange and the second flange;
the signal-in terminal and the signal-out terminal being connected to the receiver body;
the cartridge casing being positioned into the receiving volume;
the receiving volume being positioned into the receiver body;
the signal-in terminal and the signal-out terminal being positioned within the receiving volume;
the cartridge receiver further comprises a plurality of holes
the signal-in port and the signal-out port being positioned through the cartridge casing; and
the signal-in port and the signal-out port being connected to the cartridge casing.

2. The tone effects system as claimed in claim 1 comprises:
the cartridge receiver further comprises a receiving volume, a signal-in terminal, and a signal-out terminal; and
the signal-in terminal and the signal-out terminal being positioned adjacent to each other.

3. The tone effects system as claimed in claim 1 comprises:
the effects cartridge being attached to the cartridge receiver;
the signal-in terminal being positioned into the signal-in port; and
the signal-in terminal being electronically connected to the signal-in port.

4. The tone effects system as claimed in claim 1 comprises:
the signal-out terminal being positioned into the signal-out port; and
the signal-out terminal being electronically connected to the signal-out port.

5. The tone effects system as claimed in claim 1 comprises:
the effects circuit comprises a power source.

6. The tone effects system as claimed in claim 5 comprises:
the effects circuit further comprises an effects assembly;
the effects assembly being electrically connected to the power source; and
the signal-in port and the signal-out port being electronically connected to the effects assembly.

7. The tone effects system as claimed in claim 5 comprises:
the effects circuit further comprises a signal converter and a transmitter;
the signal converter being electronically connected to both the signal-in port and the transmitter; and
the signal converter and the transmitter being electrically connected to the power source.

8. The tone effects system as claimed in claim 5 comprises:
the effects circuit further comprises a speaker;
the speaker being positioned through the cartridge casing;
the speaker being electronically connected to the signal-in port; and
the speaker being electrically connected to the power source.

9. The tone effects system as claimed in claim 1 comprises:
the effects cartridge further comprises a device dock;
the device dock being positioned into the cartridge casing;
the device terminal being connected to the cartridge casing; and
the device terminal being positioned into the device dock.

10. The tone effects system as claimed in claim 1 comprises:
the effects circuit comprises a device terminal and a signal converter;
the signal converter being electronically connected to both the signal-in port and the device terminal; and
the signal converter being electrically connected to the device terminal.

11. The tone effects system as claimed in claim 1 comprises:
the effects cartridge further comprises an at least one effects control;
the at least one effects control being connected to the cartridge casing;
the at least one effects control being externally positioned on the cartridge casing; and
the at least one effects control being electronically connected to the effects circuit.

* * * * *